United States Patent [19]

Levinn et al.

[11] Patent Number: 5,058,894

[45] Date of Patent: Oct. 22, 1991

[54] MUSICAL PUZZLE TOY

[76] Inventors: Mitchell D. Levinn, R.D. 1, Box 66A, East Nassau, N.Y. 12062; Donald B. Faatz, 2 Boltwood Ave., Castleton, N.Y. 12033; Mukkai S. Krishnamoorthy, 5 24th St., Troy, N.Y. 12180

[21] Appl. No.: 653,296

[22] Filed: Feb. 11, 1991

[51] Int. Cl.[5] ..... A63F 9/06

[52] U.S. Cl. ..... 273/153 R; 273/460; 446/397

[58] Field of Search ..... 446/397, 303, 297; 273/153 R, 1 E, 237, 460

[56] References Cited

U.S. PATENT DOCUMENTS

| | | | |
|---|---|---|---|
| 4,809,979 | 3/1989 | Skowronski et al. | 273/153 R |
| 4,936,780 | 6/1990 | Cogliano | 446/397 X |
| 4,957,291 | 9/1990 | Miffitt et al. | 273/153 R |

*Primary Examiner*—Mickey Yu

*Attorney, Agent, or Firm*—Flehr, Hohbach, Test, Albritton & Herbert

[57] ABSTRACT

A cube shaped toy has a button and a rotary switch on each of the cube's six sides. For each of the cube's six faces, there is an associated set of four tones. Pushing the button on a selected face causes the toy to play the tones associated with that face. In particular, if each face is divided into four quadrants, there is one "quadrant-tone" associated with each quadrant. The toy has just six distinct tones, and when the toy is first turned on, or restarted, all four tones for each face are identical. Whenever one of the rotary switches is turned, the quadrant-tones of the associated face are rotated, and the quadrant-tones for the neighboring faces are also "rotated", generating a new set of tone patterns for each of the five affected faces. By listening to the tones for each face and rotating the rotary switches, the user can move the quadrant-tones until all four tones for each face are identical.

4 Claims, 4 Drawing Sheets

| FREQ 1 | FREQ 2 | FREQ 3 | FREQ 4 | FREQ 5 | FREQ 6 |
|---|---|---|---|---|---|
| TONE1-A | TONE1-B | TONE1-C | TONE1-D | | |
| TONE2-A | TONE2-B | TONE2-C | TONE2-D | | |
| TONE3-A | TONE3-B | TONE3-C | TONE3-D | | |
| TONE4-A | TONE4-B | TONE4-C | TONE4-D | | |
| TONE5-A | TONE5-B | TONE5-C | TONE5-D | | |
| TONE6-A | TONE6-B | TONE6-C | TONE6-D | | |
| SWITCH1-POSITION | | SWITCH2-POSITION | | | |
| SWITCH3-POSITION | | SWITCH4-POSITION | | | |
| SWITCH5-POSITION | | SWITCH6-POSITION | | | |

120

MUSICAL PUZZLE TOY

The present invention relates generally to musical toys and particularly to a electronically operated puzzle which creates patterns of musical tones.

BACKGROUND OF THE INVENTION

Most musical toys are toys which incorporate the ability to play a tune or some other set of sounds upon the occurrence of a corresponding event. The present invention is a very different type of musical toy—it is a puzzle in which the cues are musical tones.

SUMMARY OF THE INVENTION

In summary, the present invention is a cube shaped toy having a button and a rotary switch on each of the cube's six sides. For each of the cube's six faces, there is an associated set of four tones. Pushing the button on a selected face causes the toy to play the tones associated with that face. In particular, if each face is divided into four quadrants, there is one "quadrant-tone" associated with each quadrant. The toy has just six distinct tones, and when the toy is first turned on, or restarted, all four tones for each face are identical.

Whenever one of the rotary switches is turned, the quadrant-tones of the associated face are rotated, and the quadrant-tones for the neighboring faces are also "rotated", generating a new set of tone patterns for each of the five affected faces. By listening to the tones for each face and rotating the rotary switches, the user can move the quadrant-tones until all four tones for each face are identical.

This musical toy is similar to a "Rubik's cube" with four squares on each of its six faces (instead of nine squares on each face in the standard Rubik's cube), except that the colors of a Rubik's cube are replaced with musical tones. Also the faces of the musical toy do not move.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
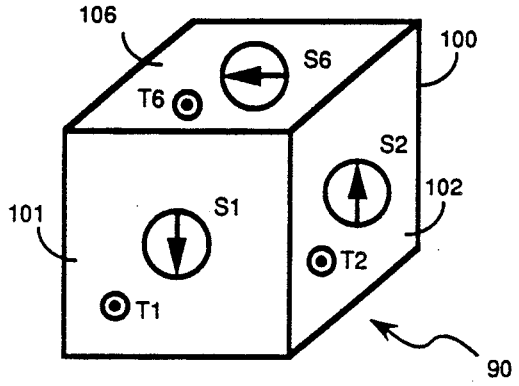
FIG. 1 depicts the exterior of one preferred embodiment of a musical toy in accordance with the present invention.

Referring to FIG. 1, there is shown a cube shaped musical toy 90. The toy has a cube shaped housing 100 which has six faces 101–106, of which only three 101, 102 and 106 are shown in FIG. 1. Each face, such as face 101, has a pushbutton T1 and a rotary switch S1. In a second preferred embodiment (not shown) the pushbuttons are located in recesses in the centers of the rotary switches.

Figure 2:
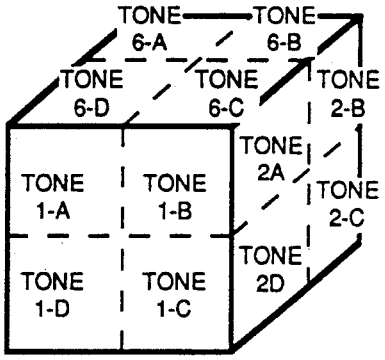
FIG. 2 schematically depicts the tone-quadrants associated with the three faces of the musical toy shown in FIG. 1.
Figure 3:
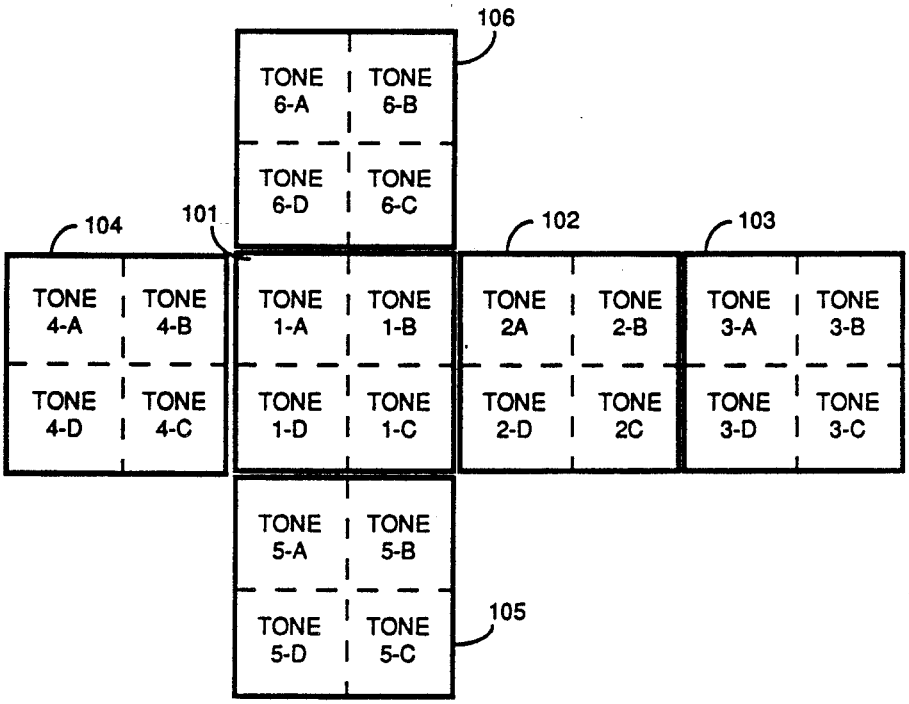
FIG. 3 is a block diagram of the tone-quadrants associated with all six faces of the musical toy shown in FIG. 1.

Referring to FIGS. 2 and 3, each of the cube's six faces has an associated set of four tones. Pushing the button on a selected face causes the toy to play the tones associated with that face. In particular, as shown in FIGS. 2 and 3, each face is conceptually divided into four "virtual" quadrants, and there is one "quadrant-tone" associated with each quadrant. These are virtual quadrants in that the four quadrants are not physically distinct, and there is no physical rotation of the quadrants—only a virtual rotation.

FIG. 3 shows the quadrant-tones for all six sides 101–106 of the toy when the housing of the toy is "unfolded." The toy 90 has just six distinct tones, and when the toy is first turned on, or restarted, all four tones for each race are identical.

Figures 5, 6:
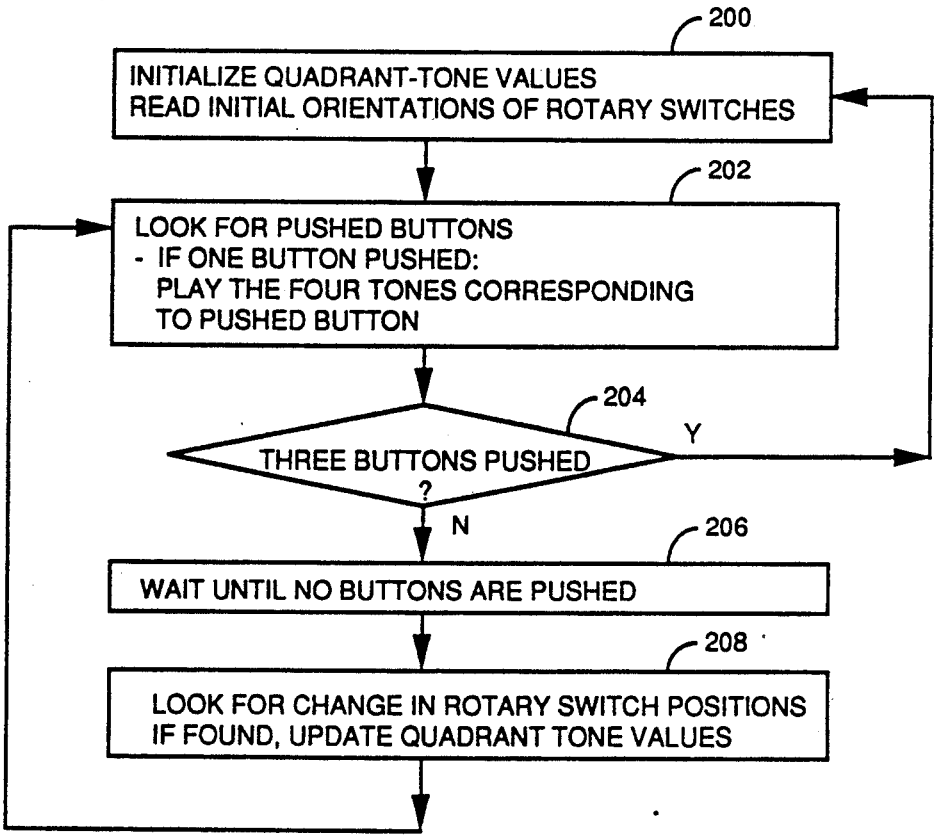
FIG. 5 depicts a table of values used by the software in the preferred embodiment.
FIG. 6 is a flow chart of the software in the preferred embodiment.

Referring to FIGS. 3 and 5, the toy's six tones are labelled FREQ1 through FREQ6. When the toy is first turned on, the six tones are assigned as follows:

TABLE 1

| QUADRANT TONES | ASSIGNED MUSICAL TONE |
|---|---|
| TONE1-A–TONE1-D | FREQ1 = 466 Hz |
| TONE2-A–TONE2-D | FREQ2 = 554 Hz |
| TONE3-A–TONE3-D | FREQ3 = 622 Hz |
| TONE4-A–TONE4-D | FREQ4 = 739 Hz |
| TONE5-A–TONE5-D | FREQ5 = 830 Hz |
| TONE6-A–TONE6-D | FREQ6 = 932 Hz |

As shown in FIG. 5, there is a table 120 of values stored in the toy which denotes the musical tones assigned to each of the twenty-four quadrant tones TONE1-A through TONE6-D. These tones are denoted in the table 120 by digital values which represent the frequency value for each of the quadrant tones.

Referring once again to FIG. 1, whenever one of the rotary switches T1–T6 is turned, the quadrant-tones of the associated face are rotated, and the quadrant-tones for the neighboring faces are also "rotated", generating a new set of tone patterns for each of the five affected faces. By listening to the tones for each face and rotating the rotary switches, the user can move the quadrant-tones until all four tones for each face are identical.

Conceptually, the musical toy 90 is similar to a "Rubik's cube" with four squares on each of its six faces (instead of nine squares on each face in the standard Rubik's cube), except that the colors of a Rubik's cube are replaced with musical tones. Also the faces of the musical toy do not move. We will now explain in detail how the toy works, and how the quadrant-tones are rotated.

Figure 4:
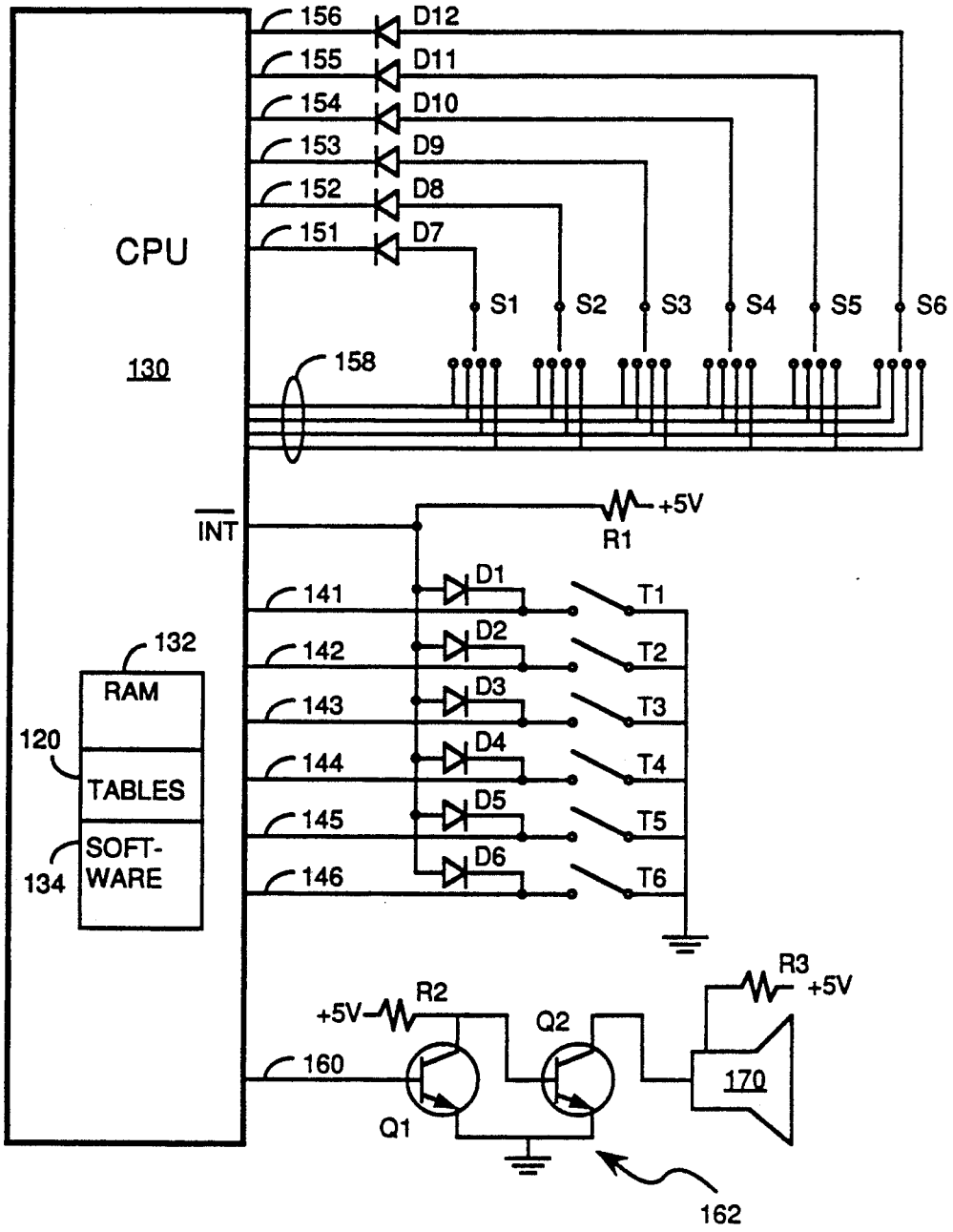
FIG. 4 is a block diagram of the electronic circuitry in the preferred embodiment.

Referring to FIG. 4, inside the toy's housing there is a microprocessor 130, which in the preferred embodiment is an 8748 microcontroller manufactured by Intel. The microprocessor 130 includes an internal random access memory array 132 which is used to store the table 120 shown in FIG. 5 as well as the software 134 which controls the operation of the microprocessor 130.

The software will be described below with reference to FIGS. 6 through 8.

The microprocessor 130 is directly coupled to the six pushbuttons T1–T6, one of which is located on each of the six cube faces 101–106. The microprocessor 130 determines which, if any, of the pushbuttons T1–T6 are depressed by scanning the six corresponding input lines 141–146.

Similarly, the microprocessor 130 is coupled to six rotary switches S1 through S6, one of which is located on each of the six cube faces 101–106, by a set of six diodes D7–D12. Each rotary switch S1–S6 has four positions. The microprocessor 130 determines the current position of each of these switches by sequentially energizing (e.g., asserting a 5 volts signal) each of the four lines 158, each of which is coupled to one of the rotary switch poles. While each line 158 is energized, the microprocessor 130 scans the six input lines 151–156 to determine which of the switches is at the corresponding position. The current position of each of the switches is stored in table 120, shown in FIG. 5. While a switch is between positions, its value is left unchanged so that when the switch reaches a new position, the microprocessor can determine whether the switch was rotated clockwise or counterclockwise, or was returned to its original position.

In addition, the microprocessor 130 is coupled by output line 160 to an amplifier 162, which in turn is coupled to a small loudspeaker 170. Tones are generated by the microprocessor 130, in a conventional manner, simply by outputting a square wave on line 160 at a frequency corresponding to the frequency of the tone to be generated.

Referring to FIG. 6, the software in the toy works as follows. When the toy is first turned on, or restarted, the twenty-four quadrant tones are assigned initial values as shown in Table 1, above. In addition, the microprocessor reads the positions of the six rotary switches S1–S6 (box 200). Then, the software executes the following loop (boxes 202, 204, 206 and 208) repeatedly until either the toy is turned off or restarted.

In the preferred embodiment, the toy is turned off automatically by a background timer software routine (not shown) when no rotary switches have been turned and no pushbuttons have been pushed for a predetermined period of time (e.g. ten minutes). Pushing any of the pushbuttons T1–T6 turns the toy back on. This function is accomplished through diodes D1–D6, which pull the CPU's interrupt line INT low on each tone switch press. Pulling the interrupt line low activates an interrupt routine in the toy's software 134 which turns the toy back on if the toy is presently off.

In the first step (box 202) of the repeating loop the microprocessor scans the pushbuttons. If just one button is depressed, the microprocessor plays the four quadrant-tones TONEx-A through TONEx-D associated with the depressed button, where x denotes the selected button. Each of the four tones is played for a predetermined period of time (e.g., 0.5 seconds) with no delay between the playing of the tones. Thus, if all the tones are the same, one hears just one tone being played (e.g., for two seconds). If two of the quadrant-tones have one value and two have a second value, then one hears either two tones played in sequence, or a first short tone, followed by a second longer tone, followed by the first tone. If the four tones are all different, one hears a series of four tones.

If no pushbuttons are depressed, or if more than one pushbutton is depressed, no tones are played.

Next, the software checks to see if three or more pushbuttons are being simultaneously depressed (box 204). If so, all the quadrant-tones are reset to their original values (box 200), and the software restarts from the beginning. This provides the user of the toy with a way to restart if the quadrant-tones are hopelessly scrambled.

The next step, assuming that three pushbuttons were not depressed, is to wait untie no pushbuttons are depressed (box 206). Then the software looks for any changes in the rotary switch positions (box 208). If there were any changes in the rotary switch positions, the corresponding quadrant-tones are updated by performing a virtual rotation of the virtual quadrants neighboring the selected rotary switch.

Figure 7:
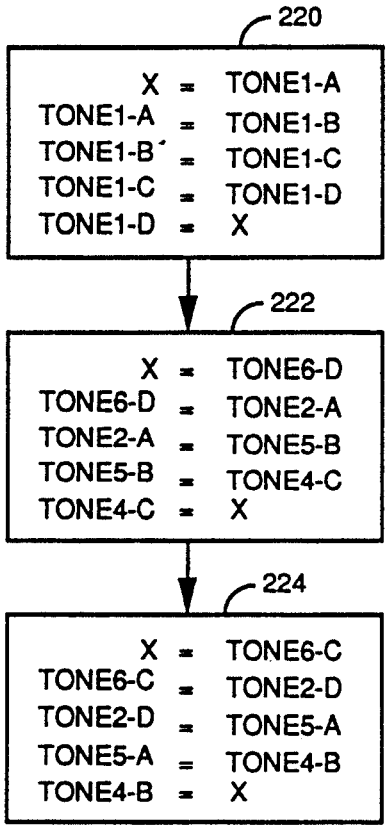
FIG. 7 is a flow chart of the software subroutine used in the preferred embodiment for handling the counterclockwise rotation of a rotary switch.
Figure 8:
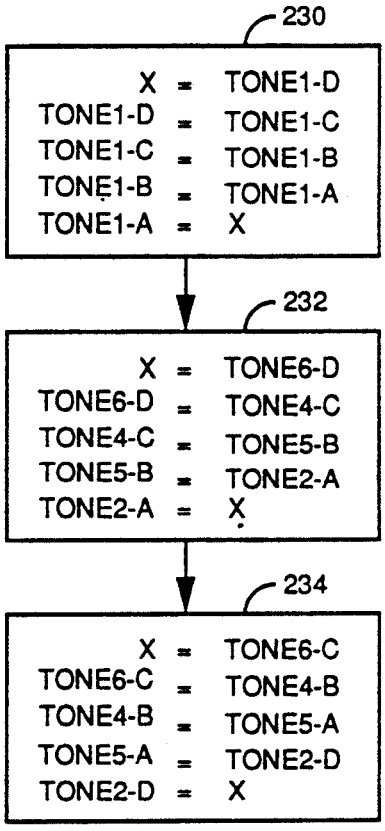
FIG. 8 is a flow chart the software subroutine used in the preferred embodiment for handling the clockwise rotation of a rotary switch.

Referring to FIGS. 3, 7 and 8, quadrant-tones are updated as follows. As can be seen by looking at FIG. 3 and box 220 of FIG. 7, if the rotary switch on face 101 is rotated counterclockwise, the four quadrant tones TONE1-A through TONE1-D are rotated as follows:

| | | |
|---|---|---|
| X | = | TONE1-A |
| TONE1-A | = | TONE1-B |
| TONE1-B | = | TONE1-C |
| TONE1-C | = | TONE1-D |
| TONE1-D | = | X |

In addition, the eight quadrant-tones neighboring face 101 are also rotated counterclockwise (boxes 222 and 224).

Similarly, referring to FIG. 8, when the switch S1 on face 101 is rotated clockwise, the four quadrant-tones on face 101 are rotated clockwise (box 230), and the eight quadrant-tones neighboring face 101 are also rotated clockwise (boxes 232 and 234).

Equivalent rotations of quadrant-tones are performed whenever any of the other rotary switches S2–S6 are turned.

With a few quick turns of the rotary switches, the original pattern of quadrant-tones can be completely changed. Then, it is the player's challenge to move the quadrant tones through successive rotations of the switches until each face plays one and only one distinct tone.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A musical toy, comprising:

a cubical housing having six faces, six pushbutton means, one on each of said six faces, for generating a face selection signal for each of said six faces;

six rotary switch means, one on each of said six faces, for generating rotary positioning signals for each of said six faces;

speaker means for playing musical tones; and control means, coupled to said six pushbutton means, said six rotary switch means and said speaker means, for denoting a set of musical tones associated with each of said six faces and for playing via said speaker means a corresponding one of said sets of musical tones whenever one of said pushbutton means generates a face selection signal;

said control means including means for reading said rotary positioning signals and determining whenever one of said rotary switch means has been rotated clockwise or counterclockwise, and for interchanging said denoted tones in accordance with a predefined algorithm whenever one of said rotary switch means is rotated.

2. A musical toy, comprising:

a cubical housing having six faces, six pushbutton means, one on each of said six faces, for generating a face selection signal for each of said six faces;

six rotary switch means, one on each of said six faces, for generating rotary positioning signals for each of said six faces;

speaker means for playing musical tones; and control means, coupled to said six pushbutton means, said six rotary switch means and said speaker means, for denoting a set of four musical tones for each of said six faces and for playing via said speaker means a corresponding one of said sets of musical tones whenever one of said pushbutton means generates a face selection signal;

said control means including means for reading said rotary positioning signals, determining whenever one of said rotary switch means has been rotated, determining which direction said switch was rotated, and interchanging said denoted tones in accordance with which one of said rotary switches was rotated and said determined direction of rotation.

3. A musical toy as set forth in claim 2, wherein said control means denotes six distinct musical tones, and includes means for denoting initial values for said denoted tones with each of said four tones for each said face being equal to a distinct one of said six musical tones.

4. A musical toy as set forth in claim 3, wherein each of said six faces has four virtual quadrants and each of said four tones denoted by said control means for each said face is assigned by said control means to a corresponding one of said four virtual quadrants;

and wherein said control means interchanges said denoted tones by performing a virtual rotation of said virtual quadrants, wherein said tones associated with each of said virtual quadrants are rotated in accordance with said virtual rotation of said virtual quadrants.

* * * * *